United States Patent [19]

Narancic

[11] 4,374,371

[45] Feb. 15, 1983

[54] CADMIUM ELECTRIC FUSE

[75] Inventor: Vojislav Narancic, Montreal, Canada

[73] Assignee: Kearney-National, Inc., Atlanta, Ga.

[21] Appl. No.: 112,733

[22] Filed: Jan. 17, 1980

[51] Int. Cl.[3] ..... H01H 85/04

[52] U.S. Cl. ..... 337/159; 337/161; 337/290

[58] Field of Search ..... 337/158, 159, 161, 290, 337/293, 295, 248

[56] References Cited

U.S. PATENT DOCUMENTS

| | | | |
|---|---|---|---|
| 1,157,919 | 10/1915 | Arsem | 337/280 |
| 1,208,448 | 12/1916 | Arthur | 337/290 |
| 3,374,328 | 3/1968 | Cameron | 337/293 X |
| 3,529,270 | 9/1970 | Kozacka | 337/248 X |
| 3,648,210 | 3/1972 | Kozacka | 337/295 X |
| 3,835,431 | 9/1974 | Rosen et al. | 337/295 X |
| 3,838,376 | 9/1974 | Norholm | 337/295 X |
| 4,001,748 | 1/1977 | Salzer | 337/159 |

*Primary Examiner*—George Harris

*Attorney, Agent, or Firm*—Rodgers & Rodgers

[57] ABSTRACT

For interrupting all values of electric current in a high voltage circuit which cause operation of a fuse within one hour, a plurality of parallel connected helically configured fusible elements formed preferably of cadmium are embedded within quartz sand in granular form disposed within a housing structure which includes a tubular member of insulating material to the ends of which terminal caps are secured and connected to the ends of the fusible elements respectively so that currents of a high order of magnitude are interrupted in a fraction of a half cycle in a current limiting fashion and so that currents of a low order of magnitude and which are slightly in excess of normal rated load current of the fuse cause the temperature of the fusible elements to rise to approximately the melting point so that the fusible elements melt in random sequence following which arcs are established progressively by commutation action along a substantial portion of the length of each fusible element by direct arc contact, by thermal conduction from arc heat and by the flow of current therethrough so as to transform it into metal vapor and oxides thereof which are dispersed quickly into the silica grains so as to establish a gap sufficient to withstand the recovery voltage.

2 Claims, 3 Drawing Figures

CADMIUM ELECTRIC FUSE

TECHNICAL FIELD

This invention relates to electric fuses which may be categorized as being of the high voltage general purpose current limiting type.

BACKGROUND ART

According to known practice a fuse is provided which is capable of interrupting all currents from the rated maximum interrupting rating down to the rated minimum interrupting rating and which is connected in series with a so-called weak link expulsion fuse which is specially designed to effect interruption of currents below the value of the miniumum interrupting current rating of the current limiting fuse. Obviously it is desirable to eliminate the practice of requiring the use of two fuses.

Another widely used system for maintaining low temperature operation of a fuse utilizing silver fusible elements utilizes the so-called Metcalf or M effect. In this type of fuse, a silver ribbon is modified by the placement of a small deposit of tin or tin alloy at one point on the silver ribbon to form an eutectic alloy with the silver to promote melting at that point on the ribbon when it reaches a temperature of approximately 230° C. In the absence of the M effect, silver elements melt at a temperature of approximately 960° C. Obviously melting temperatures of such a high order of magnitude without the eutectic effect are destructive to the fuse and are counter productive to desirable fuse operation. Where the M effect is utilized, the melting of the silver ribbon is localized at that point and the resulting arc and continued current flow must increase the ribbon temperature by an additional 700° C. approximately. In addition non-melting current flows can cause the alloy formation at the M spot to produce a permanent change in the fuse melting characteristic.

In one modification of the eutectic design, a parallel slave element is provided for the purpose of initiating two further breaks in the fusible element following the initial establishment of melting at the M spot. Such structure limits the points of melting to three and obviously is not altogether desirable and also introduces a degree of complication.

In accordance with another practice, a core is provided on which the fusible elements are wound and is constructed of gas evolving material. Where this type of structure is used venting of the housing is required. If the housing is vented of course the interrupting operation is not isolated and can result in failure of the fuse or damage to other apparatus.

Still another type of fuse utilizes a silver element connected in series with a tin element. The tin element is enclosed in an insulating tube and is expelled from the tube into the filler element to achieve low current interruption. Obviously this structure involves a measure of complication, and in addition is only suited for lower current ratings.

Still another practice has involved thermally insulating a silver wire section arranged in series with a silver ribbon. The heat concentration promotes earlier melting of the silver wire. It adds substantially to the cost of the fuse.

Still another practice has involved the use of a gold alloy in an arc quenching tube connected in series with a silver element so as to aid in the interruption of low currents.

From the above discussion of prior practices, it is evident that there are difficulties involved in interrupting low values of current. Furthermore the requirement for interrupting low currents has added substantially to the complexity of fuse designs, to their size and cost. It also limits their maximum current ratings and their application.

Cores on which fusible elements have been wound are known but are objectionable because contact with the fusible element reduces the area over which energy exchange between the arcs and the filler material can take place. Since the interrupting process requires that most of the arc energy be transferred to latent heat of fusion of the filler material, any reduction of the area of contact with the filler material is undesirable.

Areas of contact between the elements and core can produce high temperatures in the core. Ceramic materials exhibit marked reduction in their insulating properties at such elevated temperatures. This reduction in insulating property of the core results in a non-uniform voltage distribution across the fuse in the period following arcing.

Under certain transient current conditions, an appreciable temperature rise in the fusible elements may occur and may effect a deformation of the fusible elements. Repeated heating and cooling cycles may impose increasing tensile load on the fusible elements since they may not straighten out due to constriction of the sand. If movement of the elements is possible, tension may be relieved. In elements wound on a core, opportunity for relieving tension is severly restricted and mechanical failure due to tension may occur since increases in tension may break the fusible element particularly at the points of reduced cross section.

DISCLOSURE OF INVENTION

According to this invention in one form, an electric fuse is provided for interrupting an electric current of predetermined magnitude in a high voltage electric circuit wherein the electric current is passed through a homogeneous fusible element of helical configuration to cause the temperature of the fusible element to rise throughout substantially its entire length to a temperature approximating the melting temperature thereof within a predetermined time so that initial severance of the element and subsequent establishment of an arc occurs at a point along the length of the element and thereafter quickly melting the remaining parts of the fusible element due to direct contact with the initially established arc and by thermal conduction from the arc to parts of the fusible element remote from the arc and by continued flow of current through such remote parts so as to establish additional series arcs resulting in a gap sufficient to withstand the recovery voltage. The element has a low boiling temperature below the temperature of the arc. This fact facilitates prompt disbursement of the element as vapor and oxide. The oxide has a high resistance and thus aids in establishing an insulating barrier between the fuse terminals. The element is also arranged to function as a current limiting device within a brief period of time such as a fraction of a cycle in an alternating current system for currents of substantial magnitude which are typically many times the rated load current of the fuse.

In the preferred form of the invention the fusible elements are formed of cadmium of a purity between 95% and 99.999% and the fusible elements are embedded within and supported by granular filler disposed within and substantially filling a housing structure formed of insulating material and having terminal caps to which the ends of the fusible elements are connected respectively.

In one form of the invention a plurality of helical fusible elements are formed of cadmium and are effective to melt and to interrupt current many times the rated current of the fuse with a high degree of current limitation and the fusible elements are arranged to be heated to a temperature approximating the melting temperature thereof by currents of low magnitude and slightly in excess of normal rated current, the fusible elements being arranged to melt in random sequence and arcs thereafter being established and extinguished in random sequence in said fusible elements via commutation action so that the arcs may be subsequently re-established at a progressively increasing number of locations along the length of each fusible element until all of the fusible elements are substantially melted to establish long gaps which are adequate to withstand the recovery voltage.

BEST MODE OF CARRYING OUT THE INVENTION

Figure 1:
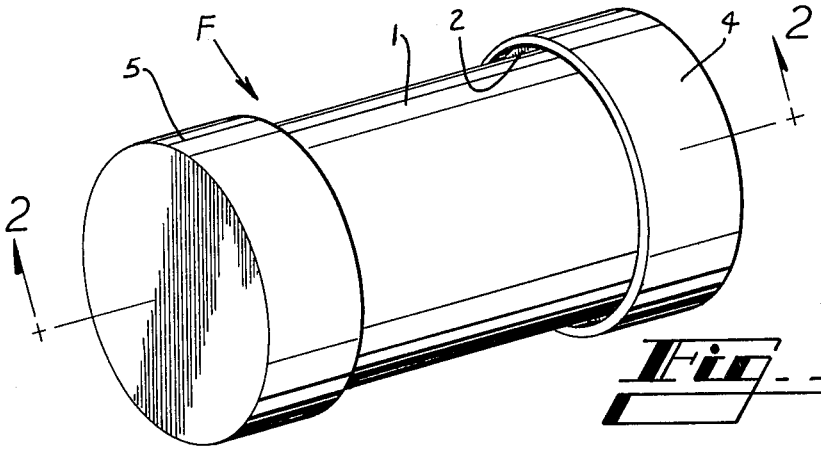
FIG. 1 is a perspective view of a fuse constructed according to one form of this invention.

In the drawings the numeral 1 designates a tubular housing formed of insulating material. End caps 2 and 3 are disposed at opposite ends of the tubular housing 1 and are formed of suitable conducting material. Outer caps 4 and 5 are secured about the end caps 2 and 3 by a pressed fit and the end caps 2 and 3 are secured to the tubular housing 1 by means of cement 6 and 7. End terminal sleeve 8 and terminal cap 9 are secured to the inner surfaces of inner caps 2 and 3 and are disposed within central apertures formed within end caps 2 and 3. The housing structure is filled with silica sand 10 which preferably is in the form of approximately spherical grains of random size within a given range. These grains preferably are composed of at least 99% silica and approximately 98% of the grains are retained on sieve mesh size 100 while approximately 2% of the grains are retained on sieve mesh size 30. Approximately 30% of the grains are retained on sieve mesh size 40 while approximately 75% are retained on sieve mesh size 50. The pellets are identified as 109 G.S.S.

Figure 2:
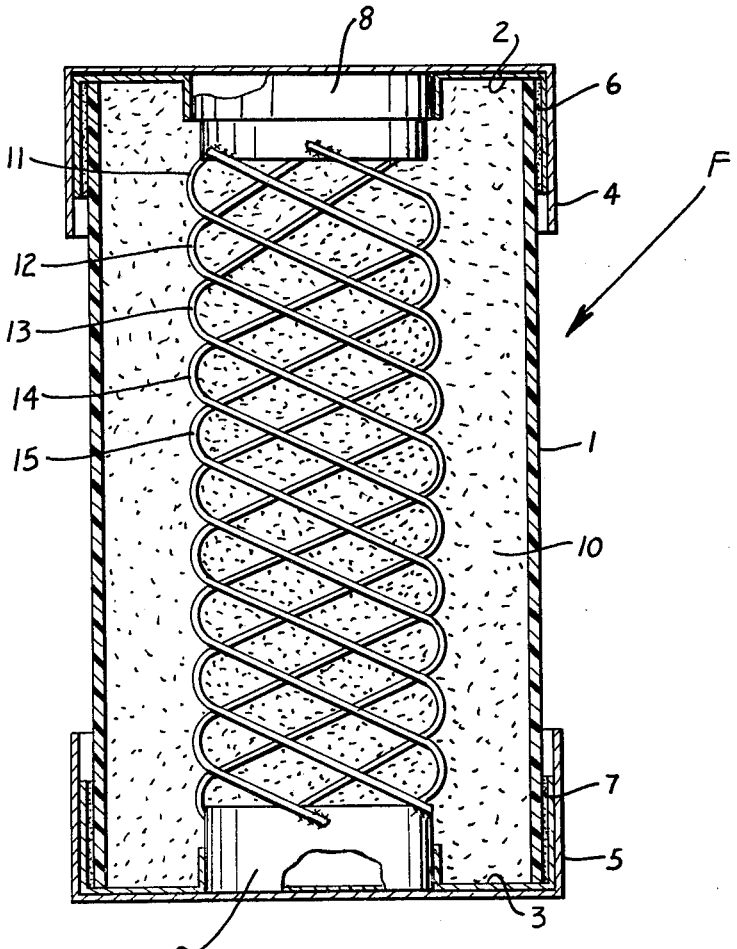
FIG. 2 is a longitudinal cross-sectional view of the structure shown in FIG. 1 with portions thereof broken away.

Disposed within the housing of the fuse and embedded within and supported by the granular filler 10 are a plurality of helical fusible elements 11–15. As is apparent from FIG. 2 these helical ribbon elements 11–15 are arranged with their ends connected with the terminal sleeve 8 and terminal cap 9 respectively. Sleeve 8 and cap 9 thus constitute terminal elements or to fusible elements of ribbon form. The portions of the fusible elements intermediate their ends are supported by the granular filler 10.

Figure 3:
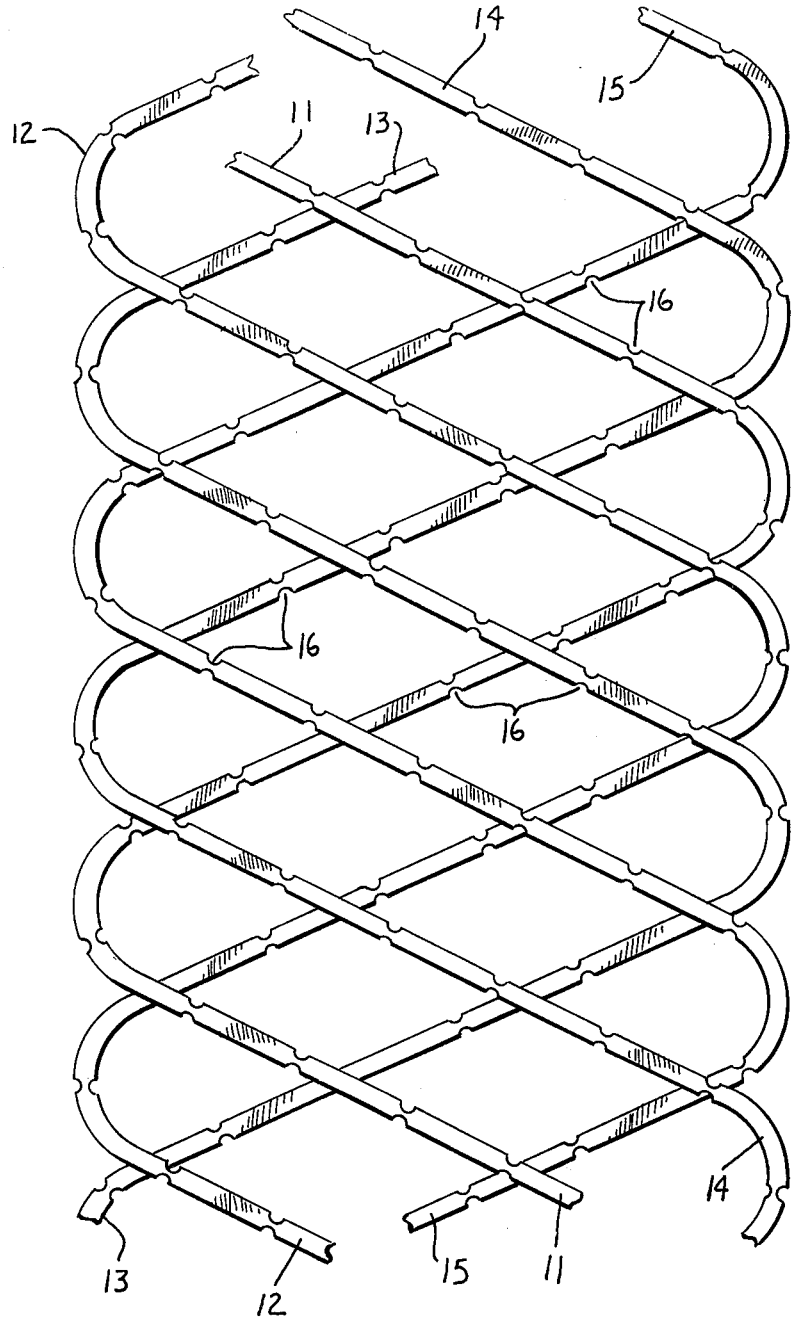
FIG. 3 is an enlarged view depicting the details of construction of the fusible elements shown in FIG. 2.

As is apparent from FIG. 3 the fusible helical elements 11–15 are provided with notches 16 which are disposed along the length of each fusible element ribbon.

Since the invention is concerned with high voltage circuits of 1,000 volts and above, it is herein categorized as a high voltage fuse.

In the event of the occurrence of a high magnitude fault current such as many times rated load current, the fusible elements 11–15 melt practically simultaneously at all of their reduced sections 16 to form a chain of arcs. These arcs quickly lengthen and burn back from their roots.

The energy of the arc in the form of heat is absorbed by the filler material in the granular form 10. The exchange of energy between the arcs and the filler material is influenced by the surface area of filler grains which is exposed to the arcs. The greater the area of this exposure the more efficient is the exchange of energy. This factor requires that the fusible elements be of ribbon form and that they be arranged as multiple elements rather than as one single element although the invention in its broader aspects is not limited to a fuse using a plurality of parallel connected fusible elements.

The use of a plurality of parallel connected elements embedded within the granular filler 10 is also beneficial in cooling the elements during normal current carrying conditions so that the more efficient the cooling the lower the total cross section of the elements required for a given current rating.

A plurality of elements is particularly beneficial in effecting interruption of currents of low magnitude which are but slightly in excess of the normal load current of the fuse. Under such low current conditions, one element melts at one point such as a notch 16 before the other elements melt. Unlike the situation involving extremely high currents, melting occurs first in one position only and in only one element. The result is a short break in the melted element. Since this short break is in parallel with the remaining elements, no arcing takes place at the initial break and the current from the first element to break is then shared between the remaining elements. Subsequently another element melts under similar conditions and its current flow is then shared between the remaining elements. All of the elements melt in sequence and with the melting of each successive element, a correspondingly higher current flow and density occurs in the remaining unmelted element or elements.

When the last remaining element melts, the fuse then begins to arc. Under low current conditions, arcs do not burn in parallel and all of the current is concentrated into one arc path. Such arcing commences in the element which offers the most attractive path and as greater arc length is achieved, the current changes to another path which becomes more attractive. The commutation of current under these conditions is a known phenomenon but as far as is known has never been previously demonstrated by photographic and oscillographic means in high voltage fuses. Establishment of an arc in one fusible element allows the arc to lengthen quickly because the fusible element is at substantially its melting temperature throughout its entire length in accordance with an important facet of this invention. Thus an arc in a fusible element may rapidly burn back substantial portions of the length of the element and cause melting not only at the notched part 16 but at the portions located between those notches. This rapid burn back and additional element melting with new arcing from an initial arc in a fusible element is due to direct contact with the arc of parts of the fusible element adjacent thereto as well as to the transfer of heat by thermal conduction and by the continued flow of current through portions of the fusible element remote from the arc. This rapid element consumption is particularly effective because the fusible element is already very near the melting point in accordance with one facet of the invention. Tests have clearly demonstrated that not only are the arcs restricted to one path at one instant but they are highly mobile and commutate at any point on the current wave. Once the commutation phase is completed and all of the fusible elements are melted throughout substantial portions of their length, the resulting gaps are sufficient to withstand the recovery voltage and the circuit current of very low magnitude is effectively interrupted.

From the description above it is apparent that an essential feature of the invention concerns the particular material chosen for the fusible elements. The material chosen should have a low melting point of 350° C. or less in order to achieve effective interruption of currents of a low order of magnitude. The oxide formed should have a high resistance so as to aid in establishing good dielectric strength after extinguishing the arc.

While the invention in its broader aspects is not limited to a particular material for use in forming the fusible elements, tests have indicated that cadmium is a desirable material. The purity of cadmium may be between 95% and 99.999%. Cadmium has a relatively low melting point and also a relatively low temperature of evaporation (approximately 750° C.). In addition when vapor of cadmium is oxidized and cooled by the granular filler, it results in a good insulator. The resistance of cadmium oxide is very high up to approximately $10^{10}$ ohms per cubic centimeter at 1000° Kelvin and for this reason cadmium is desirable for its dielectric action following a circuit interruption.

Tests have demonstratd that fusible elements formed of silver are generally not fully melted following interruption at low currents and that substantial portions of the fusible element remain intact after arcing ceases. For this and other reasons silver does not provide a fully satisfactory material for high voltage application since the unmelted parts tend to facilitate restriking by the recovery voltage. The use of cadmium with suitable design can melt in notches and create a series of short arcs necessary for interruption of current in a high voltage circuit. On the other hand in the case of small currents, cadmium fusible elements are generally melted throughout substantially their entire length and thus an effective inhibition of restrikes by the recovery voltage is achieved.

INDUSTRIAL APPLICABILITY

A fuse constructed according to this invention is well suited for use in protecting liquid filled apparatus such as transformers, capacitors, switchgear and the like. By the invention a fuse is provided which is capable of effective fast acting current limiting action for currents of high magnitude and which also operates reliably for low currents which are but slightly in excess of the normal rated current of the fuse due in part to the fact that the fusible elements may be raised by relatively low fault currents to temperature levels approaching melting without establishing an excessively high overall fuse temperature, which may be destructive to the fuse itself or damaging to insulating components adjacent to the fuse.

I claim:

1. An electric general purpose current limiting fuse for use in circuits of at least 1000 volts, said fuse comprising a tubular housing of insulating material constructed to withstand the circuit recovery voltage following a circuit interruption by the fuse, a terminal cap mounted on each end of said tubular housing and constituting closure elements thereof, quartz sand of substantially spherical grains of random size formed is excess of 99% purity and disposed within and substantially filling said housing, a plurality of substantially homogeneous helical fusible elements formed of cadmium of 95% to 99.999% purity embedded in and supported by said quartz sand and having their ends connected with said terminal elements respectively to form a plurality of parallel conducting paths therebetween, said fusible elements being effective to melt and to interrupt currents many times the rated current of the fuse with a high degree of current limitation and each of said fusible elements being heated throughout substantially the entire length thereof to a temperature approximating the melting temperature thereof and substantially below the boiling temperature thereof by currents of low magnitude and slightly in excess of normal rated current, said fusible elements being arranged to melt in random sequence and arcs thereafter being established and extinguished in random sequence in said fusible elements via commutation action.

2. An electric general purpose current limiting fuse for use in circuits of at least 1000 volts, said fuse comprising a tubular housing of insulating material constructed to withstand the circuit recovery voltage following a circuit interruption by the fuse, a terminal cap mounted on each end of said tubular housing and constituting closure elements thereof, spherical grains of quartz sand of random size and of approximately 99% purity disposed within and substantially filling said housing, a plurality of substantially homogeneous helical fusible elements each having a plurality of areas of reduced cross section spaced along the length thereof and each being formed of cadmium of 95% to 99.999% purity embedded in and supported by said quartz sand and having their ends connected with said terminal elements respectively to form a plurality of parallel conducting paths therebetween, the initiation of melting of said fusible elements occuring at less than 350° and said fusible elements being effective to melt and to interrupt currents many times the rated current of the fuse with a high degree of current limitation due at least in part to the transfer of arc energy to said quartz sand and each of said fusible elements being heated throughout substantially the entire length thereof to a temperature approximating the melting temperature thereof and substantially below the boiling temperature thereof by currents of low magnitude and slightly in excess of normal rated current, said fusible elements being arranged to melt in random sequence and arcs thereafter being established and extinguished in random sequence in said fusible elements via commutation action, arcs established and extinguished by commutation action in each fusible element being subsequently reestablished at a progressively increasing number of points along the length of each fusible element until all of said fusible elements are substantially completely burned back sufficient to establish gaps which are adequate to withstand the recovery voltage.

* * * * *